US010248072B2

(12) United States Patent
Yada et al.

(10) Patent No.: US 10,248,072 B2
(45) **Date of Patent: *Apr. 2, 2019**

(54) CLEANING ROLLER PROVIDED WITH SHAFT AND ELASTIC BODY WOUND THEREABOUT

(71) Applicant: BROTHER KOGYO KABUSHIKI KAISHA, Nagoya, Aichi (JP)

(72) Inventors: Kengo Yada, Seki (JP); Keigo Nakajima, Nagoya (JP); Yuichi Matsushita, Nagoya (JP); Hotaka Kakutani, Kiyosu (JP); Shota Iriyama, Toyokawa (JP); Atsushi Ozawa, Nagakute (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/014,652

(22) Filed: Jun. 21, 2018

(65) Prior Publication Data

US 2018/0299819 A1 Oct. 18, 2018

Related U.S. Application Data

(63) Continuation of application No. 15/421,518, filed on Feb. 1, 2017, now Pat. No. 10,031,467.

(30) Foreign Application Priority Data

Feb. 2, 2016 (JP) ..... 2016-018264

(51) Int. Cl.
*G03G 21/00* (2006.01)
*G03G 15/02* (2006.01)

(52) U.S. Cl.
CPC ..... *G03G 21/0058* (2013.01); *G03G 15/0225* (2013.01); *G03G 15/0258* (2013.01)

(58) Field of Classification Search
CPC ..... G03G 21/0058; G03G 15/0225; G03G 15/0258; G03G 15/161; G03G 2215/1647
See application file for complete search history.

(56) References Cited

U.S. PATENT DOCUMENTS 10,031,467 B2 * 7/2018 Yada ..... G03G 21/0058
2011/0170896 A1 7/2011 Yamaguchi
(Continued)

FOREIGN PATENT DOCUMENTS

JP H08-083030 A 3/1996
JP 2834716 B2 12/1998
(Continued)

OTHER PUBLICATIONS

Related U.S. Appl. No. 15/420,358, filed Jan. 31, 2017.
(Continued)

*Primary Examiner* — Sophia S Chen
(74) *Attorney, Agent, or Firm* — Scully, Scott, Murphy & Presser, P.C.

(57) ABSTRACT

A cleaning roller includes a shaft and an elastic body. The shaft extends in an axial direction where a center axis of the shaft extends. The shaft defines a radial direction and has a circumferential surface. The elastic body is helically wound about the shaft and defines a helical direction. The elastic body has a widthwise dimension in a widthwise direction orthogonal to the helical direction and to the radial direction. The elastic body has a base end portion extending in the helical direction and a distal end portion extending in the helical direction. The base end portion is in contact with the circumferential surface and fixed thereto. The distal end portion has a sharp edge and is positioned farthest from the circumferential surface in the radial direction. The widthwise dimension is gradually reduced from the base end portion to the distal end portion in the radial direction.

21 Claims, 14 Drawing Sheets

(56) References Cited

U.S. PATENT DOCUMENTS

| | | | |
|---|---|---|---|
| 2011/0170897 | A1 | 7/2011 | Hagiwara et al. |
| 2011/0170900 | A1 | 7/2011 | Suto |
| 2011/0170901 | A1 | 7/2011 | Kawai et al. |
| 2011/0318047 | A1 | 12/2011 | Nonaka et al. |
| 2014/0037320 | A1 | 2/2014 | Berens |
| 2014/0099141 | A1 | 4/2014 | Nishimura et al. |

FOREIGN PATENT DOCUMENTS

| | | | |
|---|---|---|---|
| JP | 3893225 | B2 | 3/2007 |
| JP | 2008-096822 | A | 4/2008 |
| JP | 2011-145411 | A | 7/2011 |
| JP | 2011-191677 | A | 9/2011 |

OTHER PUBLICATIONS

United States Notice of Allowance dated Mar. 26, 2018 received in related U.S. Appl. No. 15/421,518.
United States Office Action dated Oct. 10, 2017 received in related U.S. Appl. No. 15/420,358.
United States Office Action dated Oct. 24, 2017 received in related U.S. Appl. No. 15/421,518.
United States Notice of Allowance dated Feb. 21, 2018 received in related U.S. Appl. No. 15/420,358.

* cited by examiner

CLEANING ROLLER PROVIDED WITH SHAFT AND ELASTIC BODY WOUND THEREABOUT

CROSS REFERENCE TO RELATED APPLICATION

This application is a continuation application of U.S. application Ser. No. 15/421,518 filed on Feb. 1, 2017, which claims priority from Japanese Patent Application No. 2016-018264 filed Feb. 2, 2016. The entire content of the priority application is incorporated herein by reference.

TECHNICAL FIELD

The present disclosure relates to a cleaning roller used in an image forming apparatus.

BACKGROUND

Conventionally, image forming devices have been provided with a cleaning roller for cleaning waste toner and other foreign matter deposited on the surface of a photosensitive drum, the surface of an intermediate transfer belt, and the like. For example, Japanese Patent Application Publication No. 2011-145411 discloses a cleaning member for cleaning a charging member that charges an image-carrying body. The cleaning member includes a columnar-shaped core, and a foam body wound about the core in a helical shape.

SUMMARY

It is an object of the present disclosure to provide a novel cleaning roller with respect to the conventional roller described above.

In order to attain the above and other objects, according to one aspect, the disclosure provides a cleaning roller includes a shaft and an elastic body. The shaft extends in an axial direction in which a center axis of the shaft extends. The shaft defines a radial direction and has a circumferential surface. The elastic body is helically wound about the shaft and defines a helical direction. The elastic body has a widthwise dimension in a widthwise direction orthogonal to the helical direction and to the radial direction. The elastic body has a base end portion and a distal end portion. The base end portion extends in the helical direction. The base end portion is in contact with the circumferential surface and fixed thereto. The distal end portion extends in the helical direction and has a sharp edge. The distal end portion is positioned farthest from the circumferential surface in the radial direction. The widthwise dimension is gradually reduced from the base end portion to the distal end portion in the radial direction.

According to another aspect, the disclosure provides a cleaning roller produced by: preparing a shaft having a circumferential surface; preparing an elastic body extending in a prescribed direction, the elastic body having a width in a width direction orthogonal to the prescribed direction, the elastic body also having a height in a height direction orthogonal to the width direction and to the prescribed direction, the elastic body comprising: a base end portion extending in the prescribed direction; and a distal end portion extending in the prescribed direction and having a sharp edge, the width being gradually reduced from the base end portion to the distal end portion in the height direction; and helically winding and fixing the elastic body on the circumferential surface of the shaft such that the base end portion is in contact with the circumferential surface and the distal end portion is positioned farthest from the circumferential surface in a radial direction of the shaft.

BRIEF DESCRIPTION OF THE DRAWINGS

The particular features and advantages of the disclosure will become apparent from the following description taken in connection with the accompanying drawings, in which.

DETAILED DESCRIPTION

1. Overview of a Cleaning Roller 1 According to a First Embodiment

Next, an overview of a cleaning roller 1 according to a first embodiment will be described with reference to FIGS. 1 and 2.

The cleaning roller 1 includes a shaft 2, and an elastic body 3. Note that an axial direction referenced in the following description is the direction where a center axis A of the shaft 2 extends.

The shaft 2 extends in the axial direction. The material from which the shaft 2 is made is not particularly limited, provided that the shaft 2 can ensure the stiffness of the cleaning roller 1. For example, the shaft 2 may be formed of a metal, such as stainless steel or steel, or a hard resin. The shaft 2 has a columnar shape with a circular cross section. The shaft 2 has a first end portion 2A and a second end portion 2B on opposing ends in the axial direction. That is, the first end portion 2A constitutes one end portion of the shaft 2 in the axial direction, while the second end portion 2B constitutes the other end portion of the shaft 2 in the axial direction opposite the first end 2A. The second end portion 2B of the shaft 2 is spaced away from the first end portion 2A in the axial direction.

The elastic body 3 is positioned between the first end portion 2A and the second end portion 2B of the shaft 2 in the axial direction. The elastic body 3 is wound around the circumferential surface of the shaft 2.

2. Detailed Description of the Elastic Body 3

Next, the elastic body 3 will be described with reference to FIGS. 3, 4A, and 4B. In the following description, a direction orthogonal to a contact surface S3 described later will be defined as the height direction of the elastic body 3. Further, a direction orthogonal both to the direction in which the elastic body 3 extends and to the height direction of the elastic body 3 will be defined as the width direction of the elastic body 3.

(1) Shape of the Elastic Body 3

Figure 3:
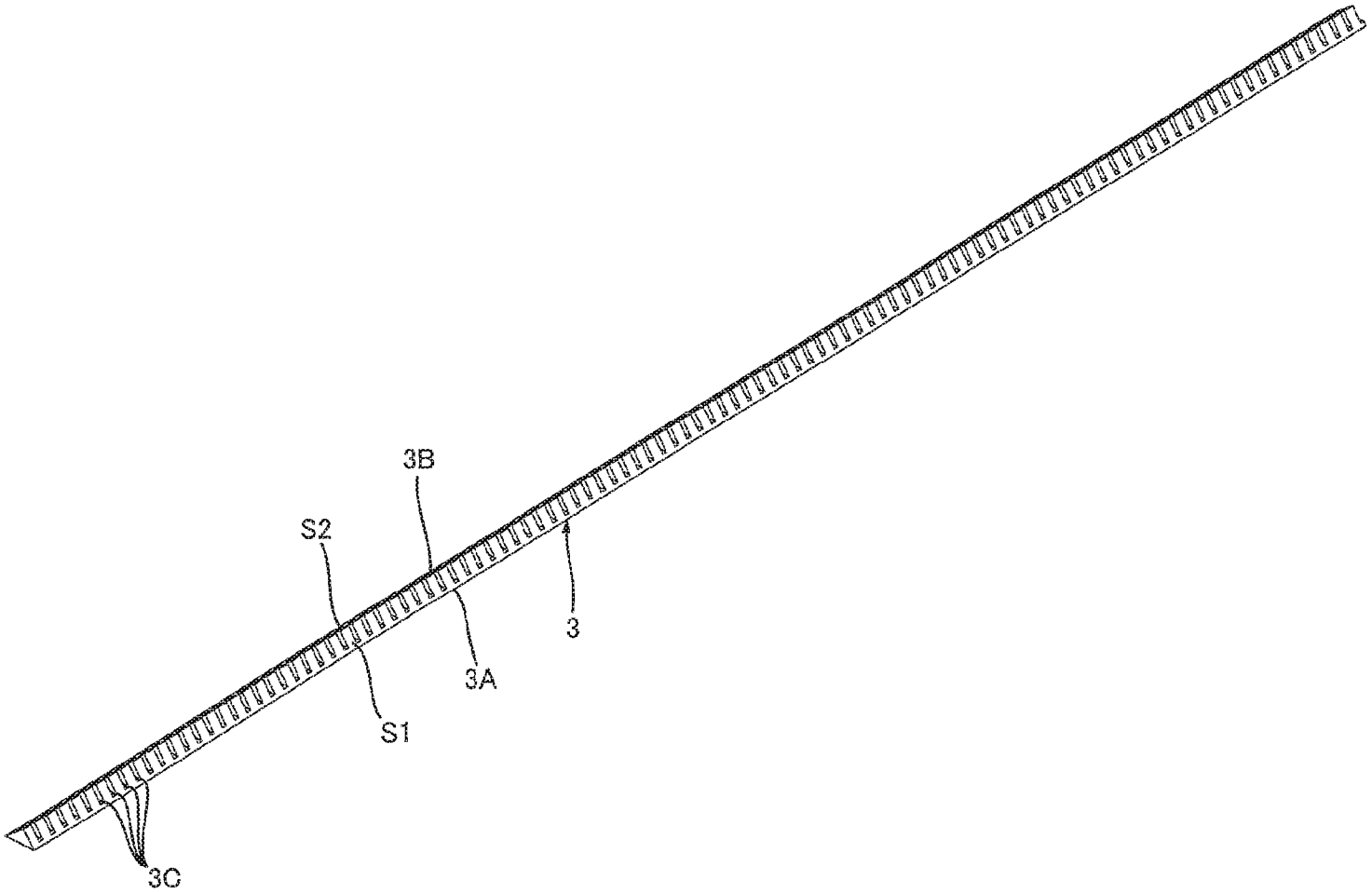
FIG. 3 is a perspective view of an elastic body of the cleaning roller illustrated in FIG. 2.

As illustrated in FIG. 3, the elastic body 3 extends in a prescribed direction prior to being wound about the shaft 2. The elastic body 3 is not particularly limited to any material, provided that the elastic body 3 can elastically deform. For example, the material of the elastic body 3 may be urethane; silicone; nitrile rubber, styrene-butadiene rubber, chloroprene rubber, or other rubbers or foam rubbers; polyester-based, polyurethane-based, or polybutadiene-based thermoplastic elastomer; and the like. The elastic body 3 is preferably formed of a foam rubber, and more preferably a urethane foam rubber.

Figure 4A:
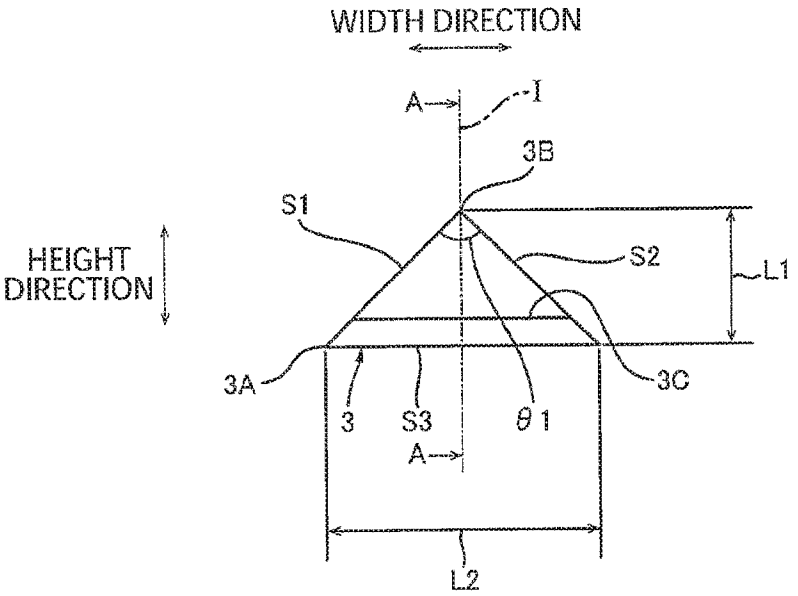
FIG. 4A is a view of the elastic body illustrated in FIG. 3, illustrating the elastic body when viewed in a direction in which the elastic body extends.

As illustrated in FIGS. 3 and 4A, the elastic body 3 has a triangular shape when viewed in the direction where the elastic body 3 extends. The elastic body 3 has a base end portion 3A, a distal end portion 3B having a sharp edge, a first surface S1, a second surface S2, and a plurality of recessed parts 3C. The shape of the elastic body 3 is symmetrical in the width direction about an imaginary plane I. The imaginary plane I extends in the height direction and passes through the distal end portion 3B.

The base end portion 3A is the end portion of the elastic body 3 that contacts the circumferential surface of the shaft 2 when the elastic body 3 is wound about the shaft 2. The base end portion 3A is continuous, with no interruptions, in the direction where the elastic body 3 extends. The base end portion 3A has a contact surface S3 that contacts the circumferential surface of the shaft 2 when the elastic body 3 is wound about the shaft 2. The base end portion 3A has one end edge in the width direction and the other end edge on the opposite side from the one end edge in the width direction. More specifically, the contact surface S3 of the base end portion 3A has one end edge in the width direction and the other end edge on the opposite side from the one end edge in the width direction.

The distal end portion 3B is the end portion of the elastic body 3 positioned farthest from the base end portion 3A in the height direction. The distal end portion 3B is interrupted by the recessed parts 3C in the direction where the elastic body 3 extends. In other words, the distal end portion 3B is discontinuous in the direction in which the elastic body 3 extends.

The first surface S1 and second surface S2 are positioned between the base end portion 3A and distal end portion 3B. The first surface S1 and second surface S2 are positioned on opposite sides of the distal end portion 3B from each other in the width direction. The first surface S1 connects the one end edge of the base end portion 3A in the width direction to the distal end portion 3B. The second surface S2 connects the other end edge of the base end portion 3A in the width direction to the distal end portion 3B. The first surface S1 slopes toward the second surface S2 in the height direction from the base end portion 3A to the distal end portion 3B. The second surface S2 slopes toward the first surface S1 in the height direction from the base end portion 3A to the distal end portion 3B. In other words, the elastic body 3 becomes gradually narrower in width from the base end portion 3A toward the distal end portion 3B. The first surface S1 and second surface S2 are connected to each other at the distal end portion 3B, thereby resulting in the distal end portion 3B having the sharp edge. Each of the first surface S1 and the second surface S2 is an example of the claimed "outer surface".

Note that the meaning of "sharp edge" may include cases in which the distal end portion 3B is rounded. That is, the distal end portion 3B is considered to have a sharp edge even when chamfered. When the distal end portion 3B has been rounded, the distal end portion 3B is considered to have a sharp edge if its radius of curvature is no greater than 2.0 mm. The distal end portion 3B is considered to have a sharp edge if the distal end portion 3B is positioned within a region surrounded by: a first imaginary plane extending along the first surface S1; a second imaginary plane extending along the second surface S2; and a virtual circle having a radius of 2.0 mm that abuts both the first and second imaginary planes. Further, the distal end portion 3B is considered to have a sharp edge if the distance in the height direction between the distal end portion 3B and a line of intersection of the two imaginary planes (i.e. the first and second imaginary planes) is within 20% of a height L1 of the elastic body 3. Further, the distal end portion 3B is considered to have a sharp edge if the distance in the height direction between the distal end portion 3B and the line of intersection of the two imaginary planes is within 0.5 mm.

Figure 4B:
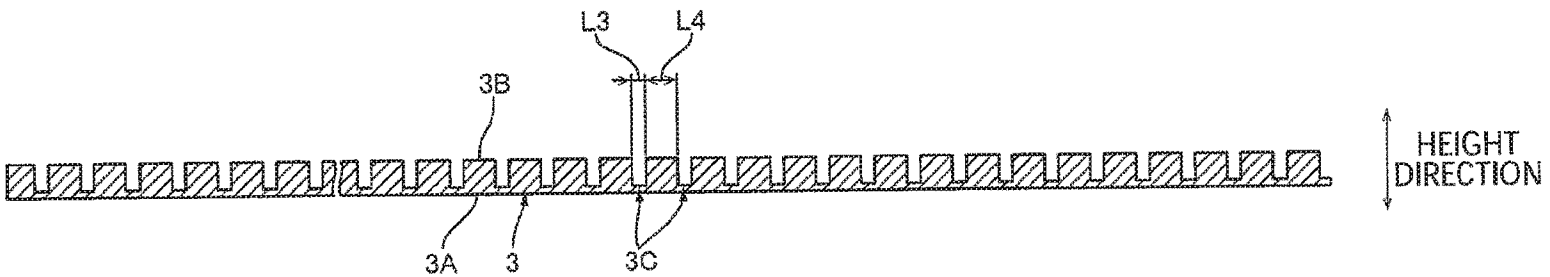
FIG. 4B is a cross-sectional view taken along line A-A of FIG. 4A, illustrating the elastic body illustrated in FIG. 4A.

As illustrated in FIGS. 3 and 4B, the recessed parts 3C are recessed from the distal end portion 3B toward the base end portion 3A in the height direction. Further, the recessed parts 3C extend in the width direction of the elastic body 3. The recessed parts 3C are arranged at intervals in the direction where the elastic body 3 extends.

(2) Dimensions of the Elastic Body 3

As illustrated in FIG. 4A, the height L1 of the elastic body 3 is defined as the distance between the base end portion 3A and distal end portion 3B in the height direction. The height L1 of the elastic body 3 is at least 0.7 mm, and preferably at least 2.0 mm, for example; and is no greater than 5.0 mm, for example.

A width L2 of the elastic body 3 is defined as the dimension of the base end portion 3A in the width direction. The width L2 of the elastic body 3 is at least 2.5 mm, and preferably at least 5 mm, for example; and is no greater than 17.5 mm, and preferably no greater than 15 mm, for example.

An angle θ1 formed by the first surface S1 and second surface S2 is at least 60°, and preferably at least 80°, for example; and is no greater than 120°, and preferably no greater than 100°, for example.

As illustrated in FIG. 4B, the recessed parts 3C have a dimension L3 in the direction where the elastic body 3 extends. The dimension L3 of the recessed parts 3C is shorter than a gap L4 between two neighboring recessed parts 3C.

The dimension L3 of the recessed parts 3C is greater than 0 mm, and preferably at least 0.3 mm, for example; and is no greater than 1.0 mm, and preferably no greater than 0.7 mm, for example.

The gap L4 between two neighboring recessed parts 3C is at least 4.5 mm, and preferably at least 10 mm, for example; and is no greater than 30 mm, and preferably no greater than 20 mm, for example.

(3) State of the Elastic Body 3 when Wound about the Shaft 2

Figure 1:
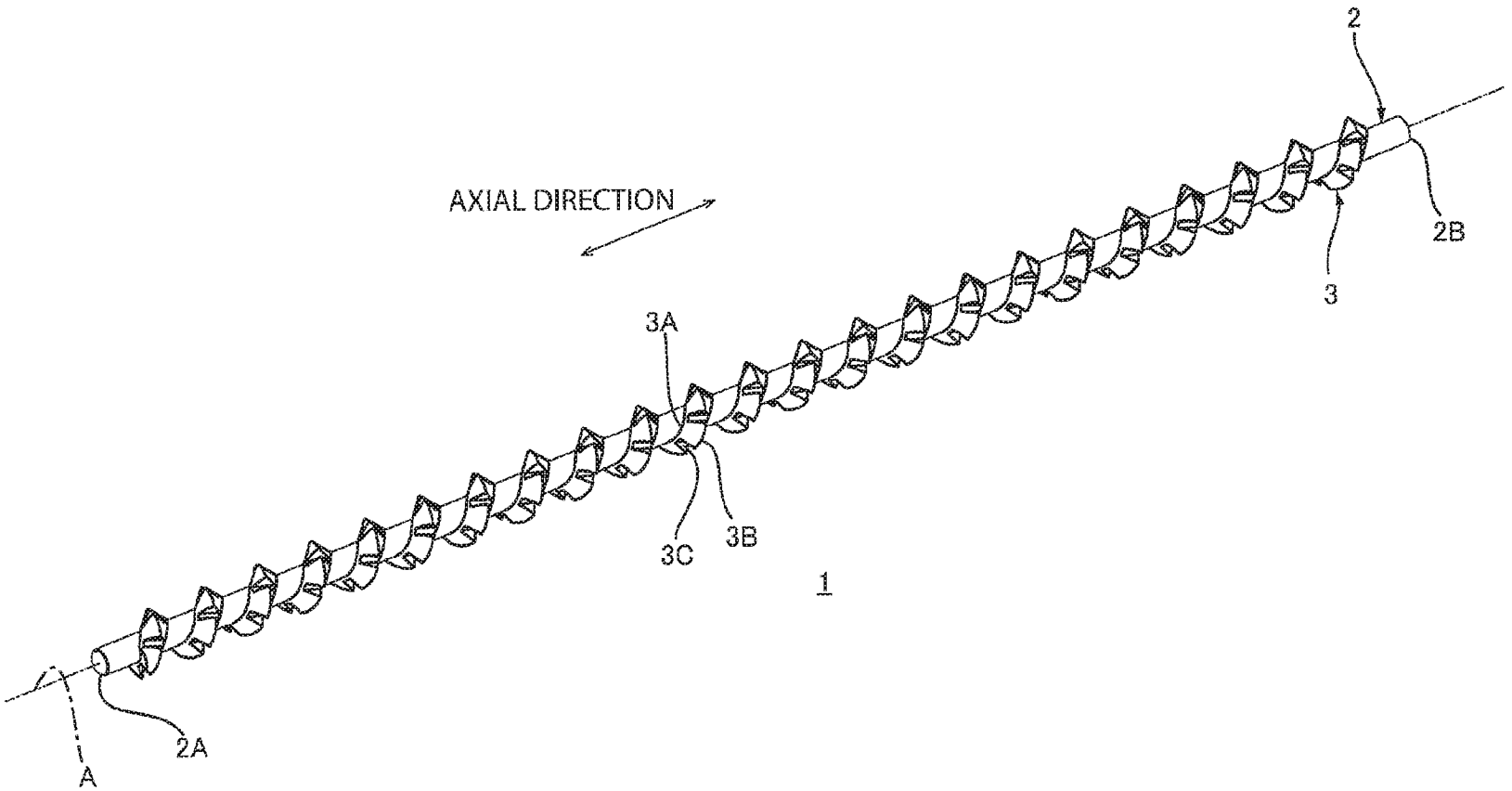
FIG. 1 is a perspective view of a cleaning roller according to a first embodiment.
Figure 2:
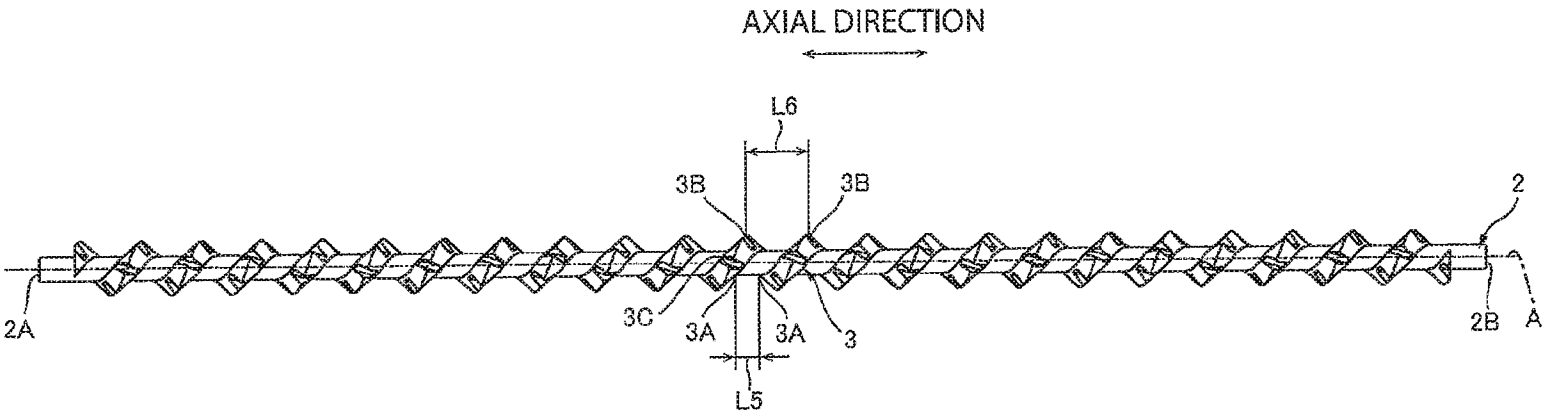
FIG. 2 is a side view of the cleaning roller illustrated in FIG. 1, illustrating the cleaning roller when viewed in a radial direction of a shaft of the cleaning roller.

As illustrated in FIGS. 1 and 2, the elastic body 3 is wound around the circumferential surface of the shaft 2 to form a helix that extends in the axial direction of the shaft 2. The helix includes a plurality of turn portions. More specifically, the helically wound elastic body 3 includes a plurality of turn portions that constitute the helix. When wound about the shaft 2, the elastic body 3 extends circumferentially around the shaft 2 at a slant to the center axis A of the shaft 2. In other words, in a wound state where the elastic body 3 is helically wound about and fixed to the shaft 2, the elastic body 3 extends in a helical direction. More specifically, in the wound state of the elastic body 3, the base end portion 3A extends in the helical direction, and also the distal end portion 3B extends in the helical direction.

Further, in the wound state, the recessed parts 3C extend in the axial direction of the shaft 2. The distal end portion 3B is interrupted by the recessed parts 3C in the helical direction. In other words, the distal end portion 3B is discontinuous in the helical direction. The base end portion 3A of the elastic body 3 is in contact with the outer circumferential surface of the shaft 2. The base end portion 3A of the elastic body 3 is fixed or bonded to the circumferential surface of the shaft 2 with adhesive, for example. The distal end portion 3B of the elastic body 3 is the part of the elastic body 3 positioned farthest from the circumferential surface of the shaft 2 in a radial direction of the same.

In the wound state, the elastic body 3 has a widthwise dimension in a widthwise direction orthogonal to the helical direction and to the radial direction of the shaft 2A. The widthwise dimension of the elastic body 3 gradually becomes smaller from the base end portion 3A to the distal end portion 3B in the radial direction.

The elastic body 3 is wound about the shaft 2 at a prescribed pitch in the axial direction. Hence, the elastic body 3 is wound about the shaft at intervals. In other words, the turn portions of the elastic body 3 are spaced at intervals in the axial direction. Stated differently, in cross-section taken along a plane containing the center axis A of the shaft 2, neighboring two of the turn portions are spaced apart from each other. Thus, the circumferential surface of the shaft 2 is exposed between the turn portions of the elastic body 3.

As illustrated in FIG. 2, a pitch L5 of the elastic body 3 is defined as the distance in the axial direction between: the base end portion 3A in one of two neighboring turn portions; and the base end portion 3A in the other of the two neighboring turn portions. The pitch L5 of the elastic body 3 is constant. The pitch L5 is at least 5 mm, and preferably at least 10 mm, for example; and is no greater than 60 mm, and preferably no greater than 40 mm, for example.

A pitch L6 of the distal end portion 3B on the elastic body 3 is defined as the distance in the axial direction between the distal end portion 3B in one of two neighboring turn portions; and the distal end portion 3B in the other of the two neighboring turn portions. The pitch L6 of the distal end portion 3B is constant. The pitch L6 is at least 5 mm, and preferably at least 35 mm, for example; and is no greater than 60 mm, and preferably no greater than 50 mm, for example.

In the wound state, a tensile force acts on the elastic body 3 in the helical direction, i.e., in the direction where the elastic body 3 extends. Consequently, the elastic body 3 deforms, and specifically the distal end portion 3B expands in the direction that the elastic body 3 extends, and the first surface S1 and second surface S2 are recessed inward in the width direction. In other words, when the elastic body 3 is wound about the shaft 2, the first surface S1 and second surface S2 become curved so as to be inwardly concave in the width direction of the elastic body 3. Consequently, the sharp edge of the distal end portion 3B becomes sharper than before the elastic body 3 is wound about the shaft 2.

Further, when the elastic body 3 is wound about the shaft 2, the recessed parts 3C open wider in the direction that the elastic body 3 extends than before the elastic body 3 is wound about the shaft 2.

3. Operational State of the Cleaning Roller 1

Next, the operational state of the cleaning roller 1 will be described with reference to FIGS. 5 and 6. Note that the cleaning target of the cleaning roller 1 in the following description is the surface of a charging roller 11. The cleaning roller 1 cleans toner deposited on the cleaning target that remains after a transfer operation.

Figure 5:
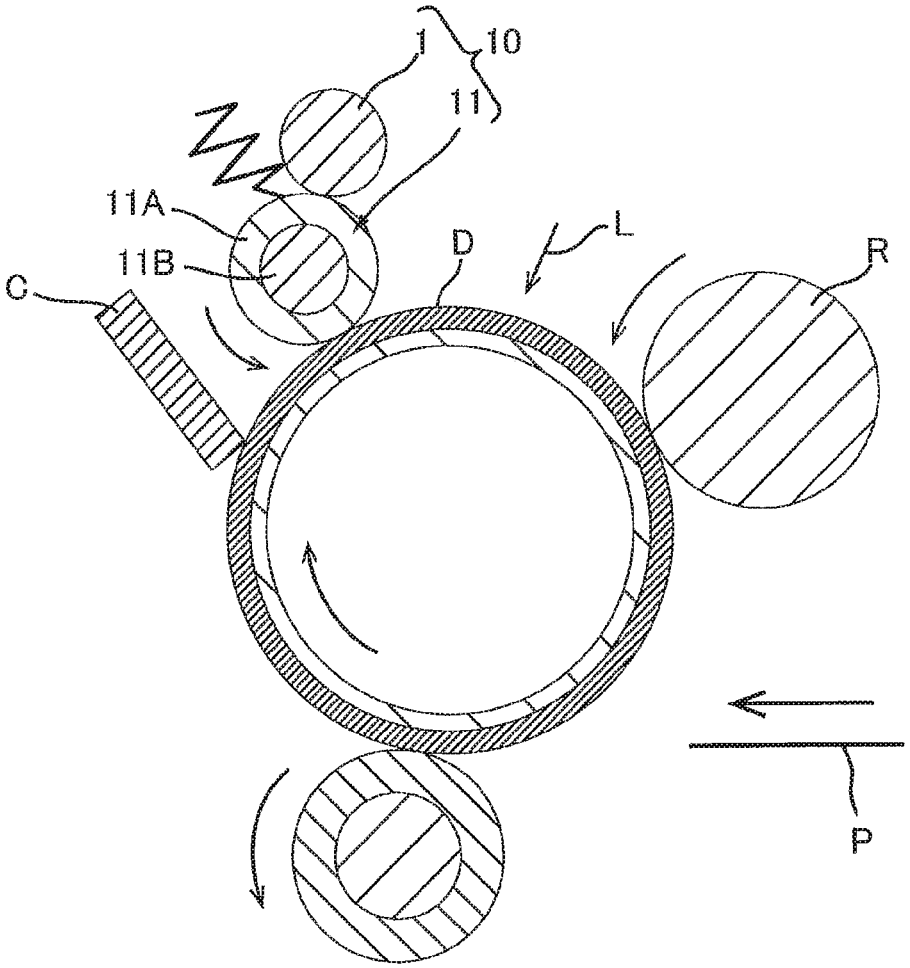
FIG. 5 is a view for description to an operational state of the cleaning roller illustrated in FIG. 1.

As illustrated in FIG. 5, the cleaning roller 1 can be used in a charging unit 10, for example.

(1) Structure of the Charging Unit 10

The charging unit 10 is a device provided in an image forming apparatus for charging the surface of a photosensitive drum D. The charging unit 10 includes the charging roller 11, and the cleaning roller 1.

Figure 6:
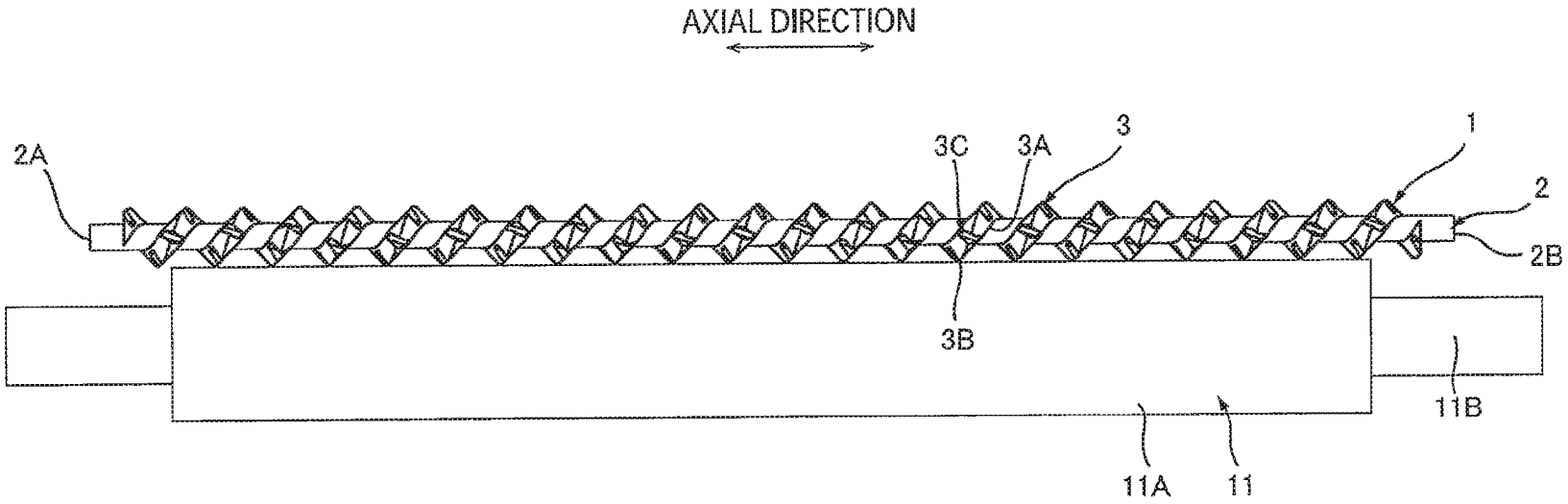
FIG. 6 is a view for description to a contact between the cleaning roller and a charging roller illustrated in FIG. 5.

As illustrated in FIGS. 5 and 6, the charging roller 11 contacts the surface of the photosensitive drum D. The charging roller 11 includes a roller 11A, and a shaft 11B. The roller 11A is elongated in the axial direction. The roller 11A has a hollow cylindrical shape. The roller 11A is formed of a conductive resin material, for example. The shaft 11B is elongated in the axial direction. The shaft 11B has a columnar shape with a circular cross section. The shaft 11B penetrates the roller 11A in the axial direction. The shaft 11B is formed of a metal, such as stainless steel or steel. The charging roller 11 is configured to charge the surface of the photosensitive drum D in a state where a prescribed charging bias is applied to the shaft 11B.

As illustrated in FIG. 6, the cleaning roller 1 contacts the surface of the charging roller 11. Specifically, the distal end portion 3B of the elastic body 3 contacts the surface of the charging roller 11 in a radial direction of the shaft 2. The distal end portion 3B of the elastic body 3 is compressed by the surface of the charging roller 11 in the radial direction of the shaft 2. The compression distance that the elastic body 3 is compressed is at least 0.1 mm, and preferably at least 0.2 mm, for example; and is no greater than 2.5 mm, and preferably no greater than 1.0 mm, for example.

The dimension of the elastic body 3 in the axial direction is longer than the length of the roller 11A constituting the charging roller 11. The surface of the shaft 2 is separated from the surface of the charging roller 11 in the radial direction of the shaft 2. The cleaning roller 1 can rotate when receiving a drive force from the image forming apparatus. Note that the distal end portion 3B of the elastic body 3 elastically returns to its original shape upon separating from the surface of the charging roller 11 as the cleaning roller 1 rotates.

(2) Cleaning Operation

As illustrated in FIG. 5, the charging roller 11 applies a uniform charge to the surface of the photosensitive drum D during an image-forming operation. Subsequently, an exposure device (not illustrated) exposes the surface of the photosensitive drum D with a light beam L, thereby forming an electrostatic latent image on the surface of the photosensitive drum D. Next, a developing roller R supplies toner onto the electrostatic latent image, forming a toner image on the surface of the photosensitive drum D. The toner image is then transferred from the photosensitive drum D to a sheet P of paper.

Thereafter, a drum cleaner C removes, from the surface of the photosensitive drum D, residual toner that was not transferred onto the sheet P. However, any residual toner that has not been removed by the drum cleaner C may inadvertently become deposited on the surface of the charging roller 11.

The cleaning roller 1 removes any residual toner that has become deposited on the surface of the charging roller 11. In other words, the cleaning roller 1 is configured to clean the surface of the charging roller 11.

Since the elastic body 3 has the helical shape, as illustrated in FIG. 6, the portion of the distal end portion 3B that contacts the surface of the charging roller 11 moves in the axial direction as the cleaning roller 1 rotates during the cleaning operation. Accordingly, the distal end portion 3B scrapes any residual toner deposited on the surface of the charging roller 11 in the axial direction.

Further, the recessed parts 3C extending in the axial direction move in the rotating direction of the cleaning roller 1 as the cleaning roller 1 rotates. Accordingly, the edges of the recessed parts 3C scrape any residual toner deposited on the surface of the charging roller 11 in the rotating direction of the cleaning roller 1.

4. Operational Advantages (1) The cleaning roller 1 according to the first embodiment described above is provided with the shaft 2, and the belt-shaped elastic body 3, as illustrated in FIG. 2. The elastic body 3 becomes gradually narrower in width from the base end portion 3A toward the distal end portion 3B, forming the sharp edge of the distal end portion 3B. The elastic body 3 is wound about the shaft 2 such that the base end portion 3A contacts the circumferential surface of the shaft 2 and the distal end portion 3B is positioned farthest from the circumferential surface in the radial direction of the shaft 2. Accordingly, the distal end portion 3B can scrape residual toner from a cleaning target in the axial direction, as illustrated in FIG. 6.

(2) Further, the elastic body 3 in the first embodiment is wound about the shaft 2 so that the turn portions of the elastic body 3 are spaced at intervals in the axial direction. Accordingly, only the minimum required length of the elastic body 3 is wound about the shaft 2, thereby efficiently configuring the cleaning roller 1.

(3) In the cleaning roller 1 according to the first embodiment, the tensile force is produced in a state where the elastic body 3 is wound about the shaft 2. This tensile force causes the distal end portion 3B to expand in the direction in which the elastic body 3 extends. Also, the tensile force causes the first surface S1 and second surface S2 that connect the distal end portion 3B to the base end portion 3A to be recessed inward in the width direction, thereby forming the sharp edge of the distal end portion 3B as an even sharper edge that can more reliably scrape foreign matter deposited on the cleaning target therefrom.

(4) In the cleaning roller 1 according to the first embodiment, the elastic body 3 may also have recessed parts 3C extending in the axial direction of the shaft 2, as illustrated in FIG. 2. Accordingly, the edges of the recessed parts 3C extending in the axial direction can scrape foreign matter deposited on the cleaning target therefrom as the cleaning roller 1 rotates.

5. Variations of the First Embodiment (1) First Variation

Figure 7:
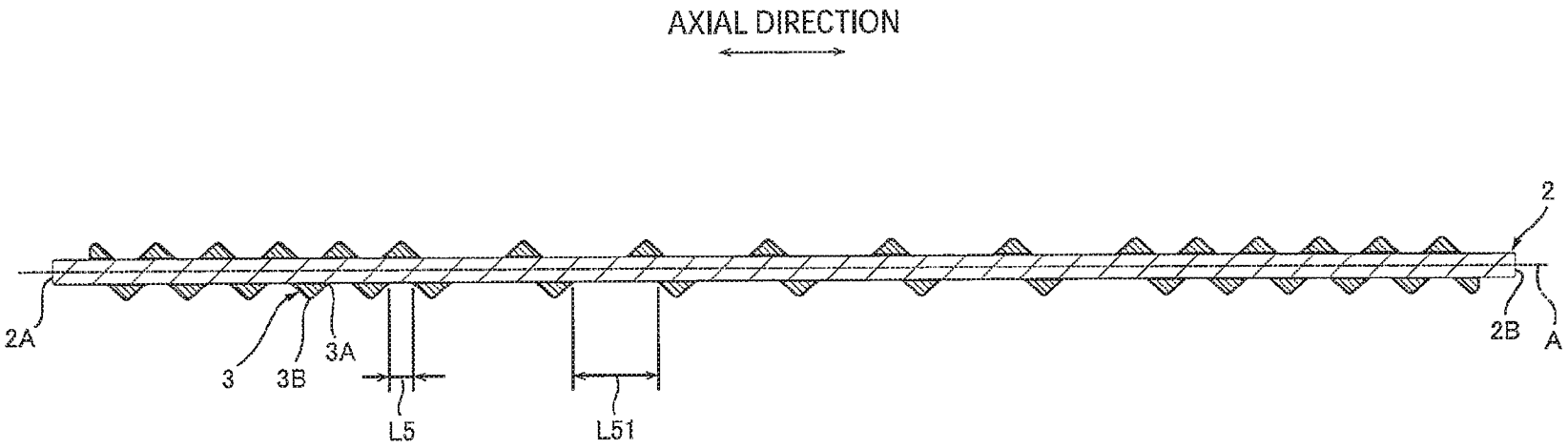
FIG. 7 is a cross-sectional view of a cleaning roller according to a first variation of the first embodiment, the cross-sectional view being taken along a plane containing a center axis of a shaft of the cleaning roller.

In the first embodiment described above, the pitch L5 of the elastic body 3 can be modified as desired. For example, as illustrated in FIG. 7, the elastic body 3 may be wound about the shaft 2 such that the turn portions of the elastic body 3 in the center region of the shaft 2 have a pitch L51 in the axial direction that is greater than the pitch L5 of the turn portions at both ends of the shaft 2. In other words, the pitch of the elastic body 3 in a center portion of the elastic body 3 in the axial direction is greater than that in both end portions of the elastic body 3 in the axial direction.

(2) Second Variation

Figure 8:
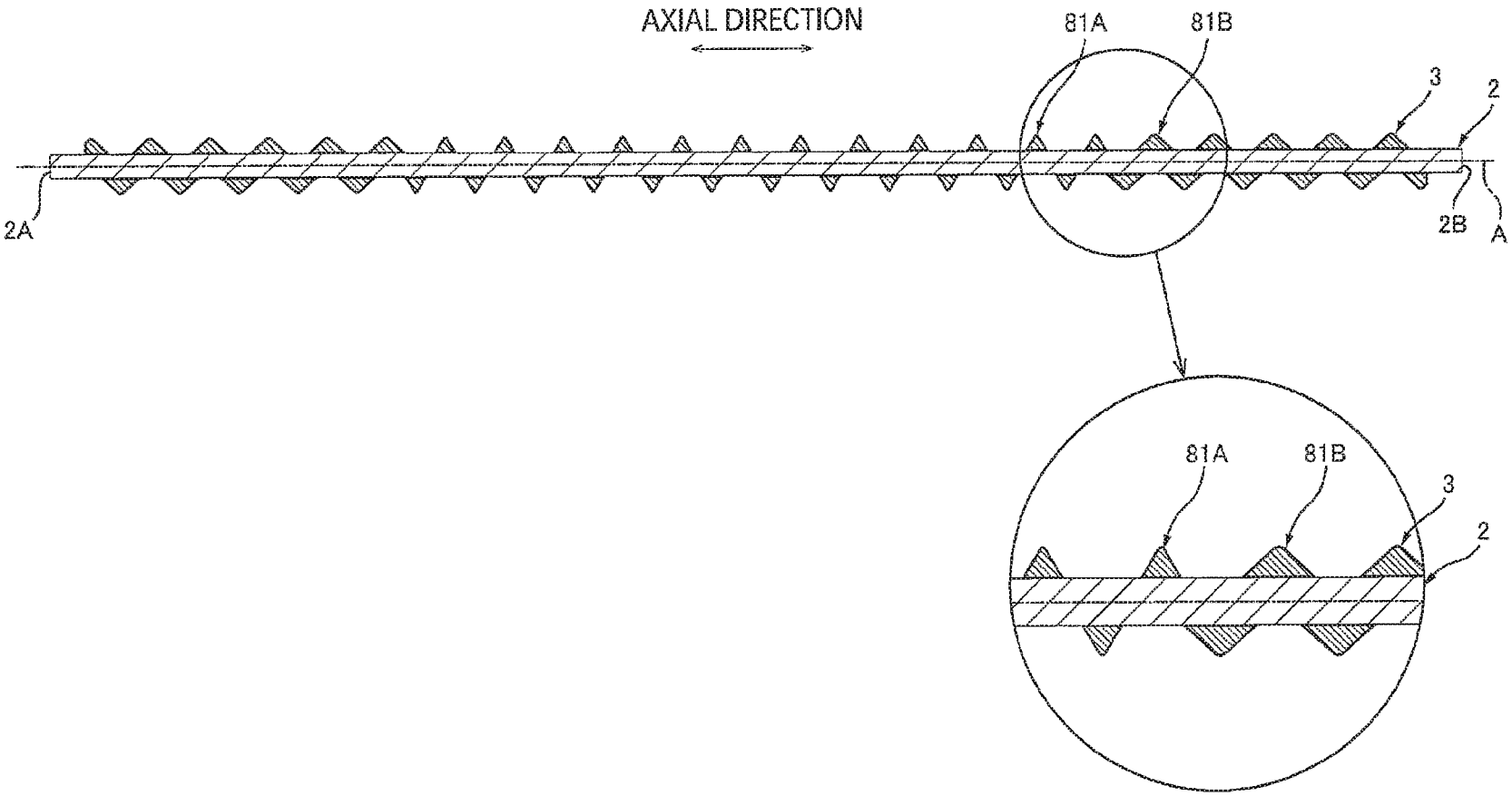
FIG. 8 is a cross-sectional view of a cleaning roller according to a second variation of the first embodiment, the cross-sectional view being taken along a plane containing a center axis of a shaft of the cleaning roller.

In the first embodiment described above, the width of the elastic body 3 can be modified. For example, as illustrated in FIG. 8, the elastic body 3 may be provided with first protruding parts 81A and second protruding parts 81B. In the wound state, each of the first protruding parts 81A constitutes a portion of the elastic body 3 in the helical direction, and also each of the second protruding parts 81B constitutes a portion of the elastic body in the helical direction. The second protruding part 81B has a width greater than that of the first protruding part 81A. In other words, in the second variation the second protruding part 81B has a different shape from the first protruding part 81A.

Prior to winding the elastic body 3 about the shaft 2, the first protruding parts 81A are positioned in the center region of the elastic body 3 in the direction that the elastic body 3 extends. The second protruding parts 81B are positioned on both end portions of the elastic body 3 in the direction that the elastic body 3 extends. In other words, the second protruding parts 81B are positioned on opposite sides of the first protruding parts 81A in the direction that the elastic body 3 extends.

In the wound state where the elastic body 3 is wound about the shaft 2, the first protruding parts 81A are positioned in the center region of the elastic body 3 in the axial direction, as illustrated in FIG. 8. The second protruding parts 81B are positioned on both end portions of the elastic body 3 in the axial direction. In other words, the second protruding parts 81B are positioned on opposite sides of the first protruding parts 81A in the axial direction. The first protruding part 81A is an example of the claimed "first part". The second protruding part 81B is an example of the claimed "second part" and is also an example of the claimed "third part".

(3) Third Variation

Figure 9:
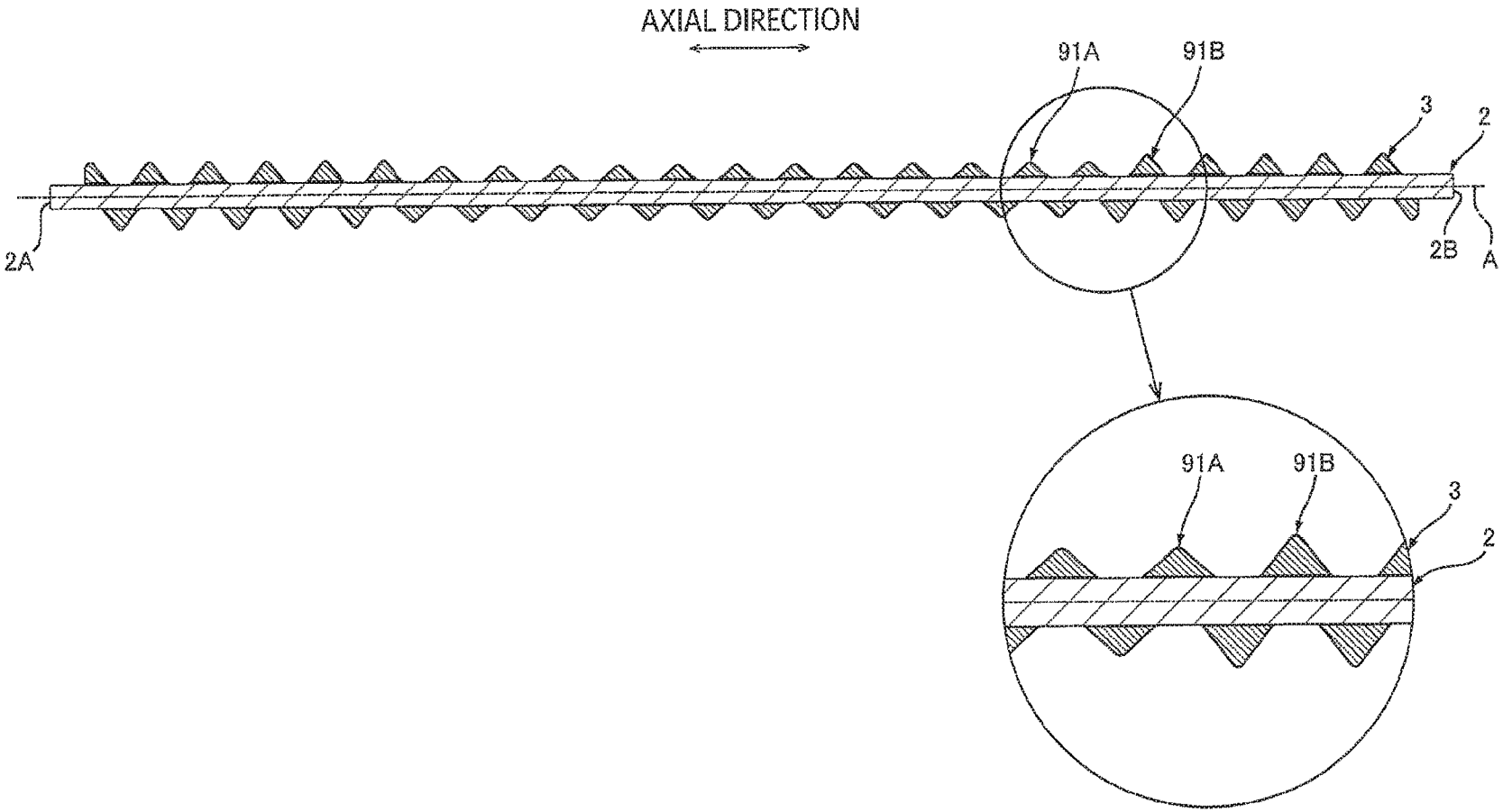
FIG. 9 is a cross-sectional view of a cleaning roller according to a third variation of the first embodiment, the cross-sectional view being taken along a plane containing a center axis of a shaft of the cleaning roller.

While the width of the elastic body 3 was modified in the second variation described above, the height of the elastic body 3 may also be modified. For example, the elastic body 3 may be provided with first protruding parts 91A and second protruding parts 91B. In the wound state, each of the first protruding parts 91A constitutes a portion of the elastic body 3 in the helical direction, and also each of the second protruding parts 91B constitutes a portion of the elastic body in the helical direction. The second protruding part 91B has a height (i.e., a height dimension in the radial direction of the shaft 2) greater than that of the first protruding part 91A, as illustrated in FIG. 9. Hence, in the third variation, the second protruding part 91B has a different shape than the first protruding part 91A. The first protruding part 91A is an example of the claimed "first part". The second protruding part 91B is an example of the claimed "second part" and is also an example of the claimed "third part".

(4) Other Variations (4-1) In the first embodiment described above, the recessed parts 3C may be omitted from the elastic body 3. In this case, the distal end portion 3B of the elastic body 3 is formed continuously in the direction in which the elastic body 3 extends with no interruptions.

(4-2) In the first embodiment described above, the recessed parts 3C of the elastic body 3 may be replaced with slits that extend in the width direction prior to the elastic body 3 being wound about the shaft 2. In this case, the tensile force exerted on the elastic body 3 when the elastic body 3 is wound about the shaft 2 widens the slits to form recessed parts.

(4-3) In the first embodiment described above, the elastic body 3 may be wound about the shaft 2 with no gaps formed between the turn portions in the axial direction, i.e., without the prescribed pitch L5 between the turn portions.

(4-4) Further, while the cleaning roller 1 in the first embodiment is used for cleaning a charging roller, the cleaning roller 1 may be used to clean a photosensitive drum or an intermediate transfer belt, for example.

(4-5) The variations described above may also be used in combination. For example, an elastic body 3 without any recessed parts 3C may be wound about the shaft 2 with no gaps between turn portions in the axial direction. Alternatively, the elastic body 3 without recessed parts 3C may be wound about the shaft 2 such that the turn portions of the elastic body 3 in the center region of the shaft 2 have the pitch L51 that is greater than the pitch L5 of the turn portions on both end portions of the shaft 2, as in the first variation illustrated in FIG. 7.

6. A Cleaning Roller 20 According to a Second Embodiment

Next, a cleaning roller 20 according to a second embodiment will be described with reference to FIG. 10A, wherein like parts and components with the cleaning roller 1 according to the first embodiment are designated with the same reference numerals to avoid duplicating description.

The cleaning roller 20 according to the second embodiment has the same configuration as the cleaning roller 1 according to the first embodiment, except that the cleaning roller 20 includes an elastic body 21 instead of the elastic body 3. The elastic body 21 has a different shape than the elastic body 3.

(1) Shape of the Elastic Body 21

Figure 10A:
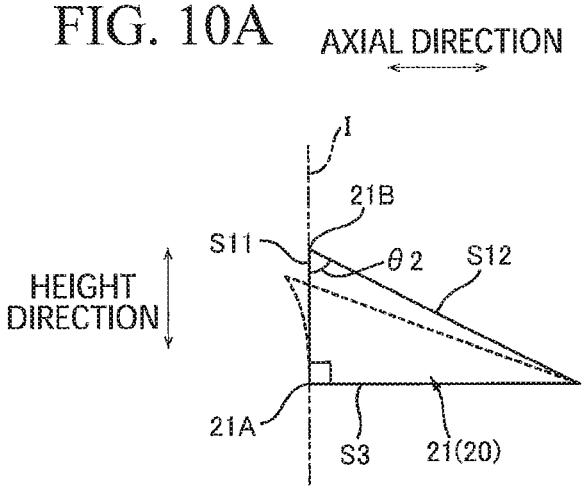
FIG. 10A is a view of an elastic body of a cleaning roller according to a second embodiment, illustrating the elastic body when viewed in a direction in which the elastic body extends.

As illustrated in FIG. 10A, the elastic body 21 has the shape of a right triangle when viewed in the direction in which the elastic body 21 extends.

A base end portion 21A of the elastic body 21 has one end edge and the other end edge in the width direction. A distal end portion 21B of the elastic body 21 has the same position in the width direction as the one end edge of the base end portion 21A. The elastic body 21 has an asymmetric shape about an imaginary plane I in the width direction. Note that the imaginary plane I extends in the height direction and passes through the distal end portion 21B.

The elastic body 21 has a first surface S11 extending in the height direction. The first surface S11 is orthogonal to the contact surface S3. The elastic body 21 also has a second surface S12 that slopes toward the first surface S11 in the height direction from the base end portion 21A toward the distal end portion 21B. In other words, the elastic body 21 becomes gradually narrower in width from the base end portion 21A toward the distal end portion 21B. The first surface S11 and second surface S12 are connected to each other at the distal end portion 21B, thereby forming the sharp edge of the distal end portion 21B. Each of the first surface S11 and the second surface S12 is an example of the claimed "outer surface".

An angle θ2 formed by the first surface S11 and second surface S12 is at least 45°, and preferably at least 55°, for example; and is no greater than 75°, and preferably no greater than 65°, for example.

(2) Operational Advantages of the Second Embodiment (2-1) The Second Embodiment can Obtain the Same Operational Advantages Described Above for the First Embodiment.

(2-2) The elastic body 21 has an asymmetric shape in the width direction about the imaginary plane I. Accordingly, when the elastic body 21 contacts the cleaning target, the elastic body 21 is curved or bent so that the distal end portion 21B becomes positioned at the same side as the curved first surface S11 with respect to the imaginary plane I, as indicated by the dashed line in FIG. 10A. In other words, when the elastic body 21 contacts the cleaning target, the distal end portion 21B is positioned opposite to the other end edge of the base end portion 21A with respect to the imaginary plane I. The bent elastic body 21 has elastic restoring force in the width direction from the first surface S11 toward the first surface S11. By this elastic restoring force, the elastic body 21 can reliably convey residual toner on the cleaning target from the first surface S11 toward the second surface S12 in the width direction.

(3) Variations of the Second Embodiment

In the second embodiment described above, the distal end portion 21B of the elastic body 21 has no particular restrictions, provided that the distal end portion 21B has a sharp edge.

(3-1) First Variation

Figure 10B:
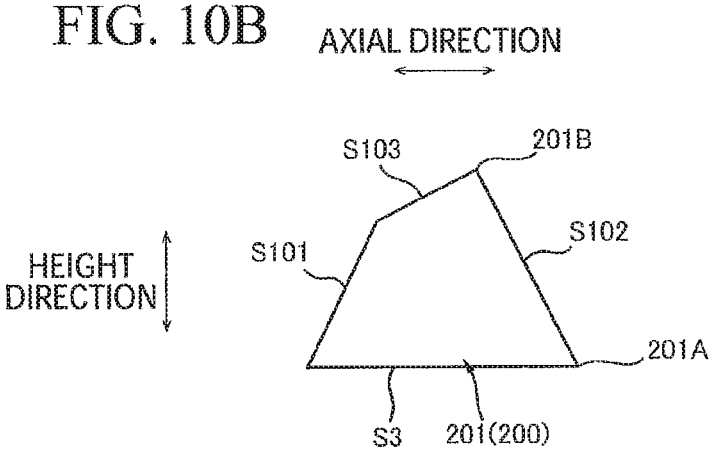
FIG. 10B is a view of an elastic body of a cleaning roller according to a first variation of the second embodiment, illustrating the elastic body when viewed in a direction in which the elastic body extends.

For example, a cleaning roller 200 illustrated in FIG. 10B may be provided with an elastic body 201 that differs in shape from the elastic body 21 according to the second embodiment described above.

The elastic body 201 has a general rectangular shape when viewed in the direction in which the elastic body 201 extends. The elastic body 201 has a first surface S101, a second surface S102, and a third surface S103, each of which is positioned between a base end portion 201A and a distal end portion 201B.

The first surface S101 and second surface S102 are positioned on opposite sides of the distal end portion 201B in the width direction. The first surface S101 is connected to one edge of the base end portion 201A in the width direction. The first surface S101 is separated from the distal end portion 201B in the width direction and in the height direction. The second surface S102 is connected both to the other edge of the base end portion 201A in the width direction and to the distal end portion 201B. The first surface S101 slopes toward the second surface S102 in the height direction from the base end portion 201A toward the distal end portion 201B. The second surface S102 slopes toward the first surface S101 in the height direction from the base end portion 201A to the distal end portion 201B. In other words, the elastic body 201 becomes gradually narrower in width from the base end portion 201A toward the distal end portion 201B.

The third surface S103 is positioned between the first surface S101 and distal end portion 201B in both the width direction and the height direction. The third surface S103 slopes toward the second surface S102 in the height direction from the base end portion 201A toward the distal end portion 201B. The third surface S103 is connected to the second surface S102 at the distal end portion 201B, thereby forming the sharp edge of the distal end portion 201B. A surface constituted by the first surface S101 and the third surface S103 is an example of the claimed "outer surface". Also, the second surface S102 is an example of the claimed "outer surface".

(3-2) Second Variation

Figure 10C:
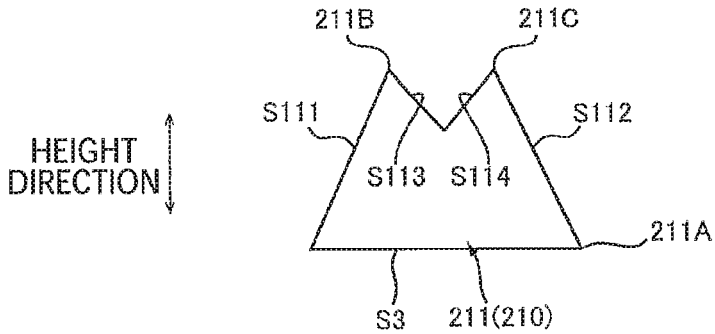
FIG. 10C is a view of an elastic body of a cleaning roller according to a second variation of the second embodiment, illustrating the elastic body when viewed in a direction in which the elastic body extends.

Further, a cleaning roller 210 illustrated in the example of FIG. 10C may include an elastic body 211 having two distal end portions, i.e., a first distal end portion 211B and a second distal end portion 211C. The first and second distal end portions 211B and 211C are spaced apart from each other in the width direction.

The elastic body 211 has a first surface S111, a second surface S112, a third surface S113, and a fourth surface S114, each of which is positioned between a base end portion 211A and the first and second distal end portions 211B and 211C. The base end portion 211A has one end edge and the other end edge in the width direction. The one end edge is closer to the first distal end portion 211B in the width direction than the other end edge is to the first distal end portion 211B.

The first surface S111 and second surface S112 are positioned on opposite sides of the two distal end portions 211B and 211C in the width direction, that is the first and second distal end portions 211B and 211C are positioned between the first and second surfaces S111 and S112. The first surface S111 and second surface S112 are spaced away from each other in the width direction. The first surface S111 connects the one end edge of the base end portion 211A to the first distal end portion 211B. The second surface S112 connects the other end edge of the base end portion 211A to the second distal end portion 211C. The first surface S111 slopes toward the second surface S112 in the height direction from the base end portion 211A to the first distal end portion 211B. The second surface S112 slopes toward the first surface S111 in the height direction from the base end portion 211A to the first distal end portion 211B. In other words, the elastic body 211 becomes gradually narrower in width from the base end portion 211A toward the first distal end portion 211B. Each of the first surface S111 and the second surface S112 is an example of the claimed "outer surface".

The third surface S113 is positioned between the first surface S111 and second surface S112 in the width direction. The third surface S113 slopes toward the first surface S111 in the height direction from the base end portion 211A toward the first distal end portion 211B. The third surface S113 is connected to the first surface S111 at the first distal end portion 211B, thereby forming the first distal end portion 211B that has a sharp edge. Note that the third surface S113 is spaced away from the second surface S112 in the width direction.

The fourth surface S114 is positioned between the third surface S113 and second surface S112 in the width direction. The fourth surface S114 slopes toward the second surface S112 in the height direction from the base end portion 211A toward the distal end portion 211B. The fourth surface S114 is connected to the second surface S112 at the second distal end portion 211C, thereby forming the second distal end portion 211C that has a sharp edge.

(3-3) The above variations can obtain the same operational advantages as the first embodiment described above.

7. A Cleaning Roller 30 According to a Third Embodiment

Figure 11A:
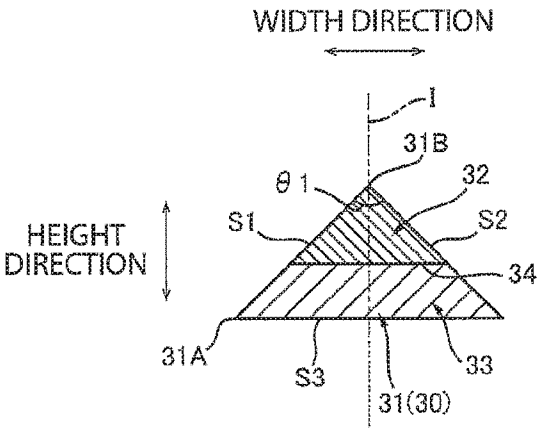
FIG. 11A is a cross-sectional view of an elastic body of a cleaning roller according to a third embodiment, the cross-sectional view being taken along a plane orthogonal to a direction in which the elastic body extends.

Next, a cleaning roller 30 according to a third embodiment will be described with reference to FIG. 11A, wherein like parts and components with the cleaning roller 1 in the first embodiment are designated with the same reference numerals to avoid duplicating description.

The cleaning roller 30 according to the third embodiment has the same structure as the cleaning roller 1 in the first embodiment, except that an elastic body 31 of the cleaning roller 30 includes a first portion 32, and a second portion 33 formed of a different material from the first portion 32.

(1) The Elastic Body 31

The first portion 32 of the elastic body 31 is positioned closer to a distal end portion 31B of the elastic body 31 in the height direction than the second portion 33 is to the distal end portion 31B. The first portion 32 includes the distal end portion 31B. The second portion 33 is positioned farther from the distal end portion 31B in the height direction than the first portion 32 is from the distal end portion 31B. A boundary plane 34 between the first portion 32 and second portion 33 extends in the width direction. The boundary plane 34 is parallel to the contact surface S3 of the base end portion 31A.

The first portion 32 has a symmetrical shape in the width direction about the imaginary plane I. Note that the imaginary plane I in the third embodiment extends in the height direction and passes through the distal end portion 31B. The first portion 32 is formed of a material that is harder and more resistant to abrasion than the second portion 33. More specifically, the material of the first portion 32 is harder than that of the second portion 33, and also the material of the first portion 32 has a volumetric wear rate lower than that of the material of the second portion 33. For example, the first portion 32 may be formed of a material such as a silicone resin or a urethane resin. The material of the first portion 32 is an example of the claimed "first material".

The second portion 33 has a shape that is symmetrical in the width direction about the imaginary plane I. The second portion 33 is formed of a material that is softer than the first portion 32 and has a higher elastic restoring force than that of the first portion 32. More specifically, the material of the second portion 33 is softer than that of the first portion 32, and also the material of the second portion 33 has a higher restitution coefficient than that of the material of the first portion 32. For example, the second portion 33 may be configured of a foam body formed of urethane resin. The material of the second portion 33 is an example of the claimed "second material".

(2) With the cleaning roller 30 according to the third embodiment, the elastic body 31 has the first portion 32 that includes the distal end portion 31B, and the second portion 33 that is formed of a different material from the first portion 32. The first portion 32 is formed of a material that has more resistant to abrasion than the second portion 33, while the second portion 33 is formed of a material that has a higher elastic restoring force than that of the first portion 32.

Operational Advantages of the Third Embodiment

Hence, by the elastic restoring force of the second portion 33, the distal end portion 31B can be brought into contact with the cleaning target. Further, by the first portion 32 that is more resistant to abrasion than that of the second portion 33, abrasion of the distal end portion 31B can be suppressed. As a result, the distal end portion 31B can reliably scrape foreign matter deposited on the cleaning target.

(3) Variations of the Third Embodiment (3-1) First Variation

Figure 11B:
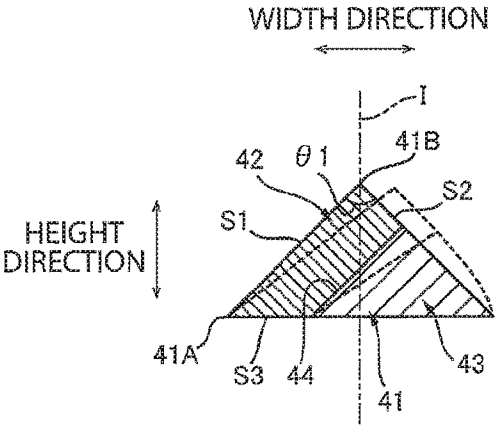
FIG. 11B is a cross-sectional view of an elastic body of a cleaning roller according to a first variation of the third embodiment, the cross-sectional view being taken along a plane orthogonal to a direction in which the elastic body extends.

As illustrated in FIG. 11B, the cleaning roller according to the third embodiment described above may have an elastic body 41 provided with a first portion 42 that is offset in the width direction.

More specifically, in this variation a boundary plane 44 between the first portion 42 and a second portion 43 slopes toward the second surface S2 in the height direction from a base end portion 41A toward a distal end portion 41B. The boundary plane 44 is parallel to the first surface S1.

With this configuration, the first portion 42 is biased toward a side as the same as the first surface S1 with respect to the imaginary plane I in the width direction. In the first portion 42, the volume of the portion positioned on the same side as the first surface S1 with respect to the imaginary plane I is greater than the volume of the portion positioned on a side the same as the second surface S2 with respect to the imaginary plane I in the width direction. In this variation, the imaginary plane I extends in the height direction and passes through the distal end portion 41B. The first portion 42 includes the distal end portion 41B.

Further, the second portion 43 is biased toward the same side as the second surface S2 with respect to the imaginary plane I in the width direction. In the second portion 43, the volume of the portion positioned on the same side as the second surface S2 with respect to the imaginary plane I is greater than the volume of the portion positioned on the same side as the first surface S1 with respect to the imaginary plane I.

Further, the first surface S1 of the elastic body 41 is constituted by the first portion 42. The second surface S2 of the elastic body 41 is constituted by both the first portion 42 and the second portion 43. Specifically, the part of the second surface S2 nearest the distal end portion 41B in the height direction is constituted by the first portion 42, and the part nearest the base end portion 41A in the height direction is constituted by the second portion 43.

When the elastic body 41 in this variation contacts the cleaning target, the elastic body 41 is deformed with a bias, as indicated by the dashed line in FIG. 11B. That is, elastic deformation of the first portion 42 is suppressed, while elastic deformation of the second portion 43 positions the distal end portion 41B on the same side as the second surface S2 with respect to the imaginary plane I.

Accordingly, through the elastic restoring force of the second portion 43, the elastic body 41 can reliably convey foreign matter deposited on the cleaning target in the width direction, and specifically in the direction from the second surface S2 toward the first surface S1.

(3-2) Second Variation

Figure 11C:
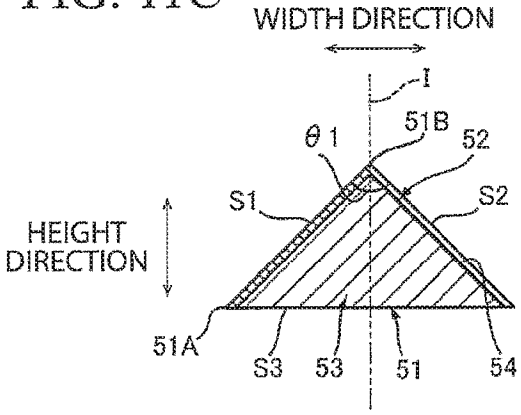
FIG. 11C is a cross-sectional view of an elastic body of a cleaning roller according to a second variation of the third embodiment, the cross-sectional view being taken along a plane orthogonal to a direction in which the elastic body extends.

As illustrated in FIG. 11C, the cleaning roller according to the third embodiment described above may include an elastic member 51 whose second portion 53 is coated with a first portion 52.

More specifically, the first portion 52 coats or covers a surface 54 of the second portion 53 between a base end portion 51A and a distal end portion 51B. Further, the first portion 52 coats the second portion 53 at the distal end portion 51B, whereby the first portion 52 includes the distal end portion 51B.

Note that the first portion 52 and second portion 53 have shapes that are symmetrical in the width direction about the imaginary plane I.

(3-3) Third Variation

Figure 11D:
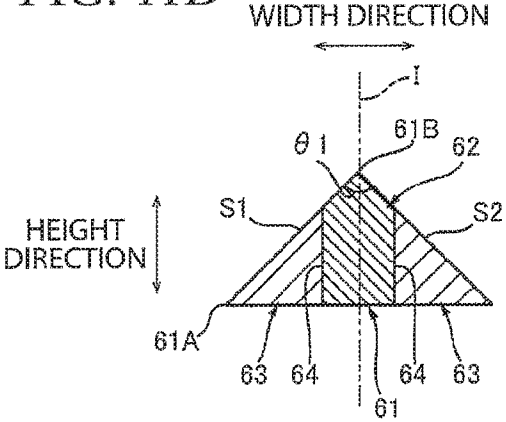
FIG. 11D is a cross-sectional view of an elastic body of a cleaning roller according to a third variation of the third embodiment, the cross-sectional view being taken along a plane orthogonal to a direction in which the elastic body extends.

As illustrated in FIG. 11D, the cleaning roller according to the third embodiment may have a first portion 62 arranged in the widthwise center of an elastic body 61, and second portions 63 disposed on both sides of the first portion 62 in the width direction.

Specifically, the first portion 62 extends from a base end portion 61A to a distal end portion 61B in the height direction. Boundary planes 64 between the first portion 62 and the second portions 63 extend in the height direction.

Note that the first portion 62 and second portions 63 have shapes that are symmetrical in the width direction about the imaginary plane I.

8. A Cleaning Roller According to a Fourth Embodiment

Next, a cleaning roller 70 according to a fourth embodiment will be described with reference to FIGS. 12 and 13, wherein like parts and components with the cleaning roller 1 in the first embodiment are designated with the same reference numerals to avoid duplicating description.

The cleaning roller 70 according to the fourth embodiment has the same structure as the cleaning roller 1 according to the first embodiment, except that the cleaning roller 70 is provided with an elastic body 71 that configures a double helix together with the elastic body 3.

(1) the Elastic Body 71

The elastic body 71 has the same shape as the elastic body 3 and is helically wound about the shaft 2 at positions between the turn portions of the elastic body 3 in the axial direction, thereby configuring a double helix together with the elastic body 3. The recessed parts 3C in the elastic body 71 are disposed at approximately the same positions as the recessed parts 3C in the elastic body 3 in the rotating direction of the shaft 2.

The elastic body 71 may be formed of the same material as the elastic body 3 or a different material from the elastic body 3. When the elastic body 71 is formed of a different material from the elastic body 3, the volumetric wear rate of the elastic body 71 may be different from that of the elastic body 3. Additionally, the restitution coefficient of the elastic body 71 may be different from that of the elastic body 3. The elastic body 71 is an example of the claimed "second elastic body". A direction in which the helically wound elastic body 71 extends is an example of the claimed "second helically direction". The base end portion 3A of the elastic body 71 is an example of the claimed "second base end portion". The distal end portion 3B of the elastic body 71 is an example of the claimed "second distal end portion". The contact surface S3 of the elastic body 71 is an example of the claimed "second contact surface". The first surface S1 of the elastic body 71 is an example of the claimed "third surface". The second surface S2 of the elastic body 71 is an example of the claimed "fourth surface".

(2) Operational Advantages of the Fourth Embodiment

Figure 12:
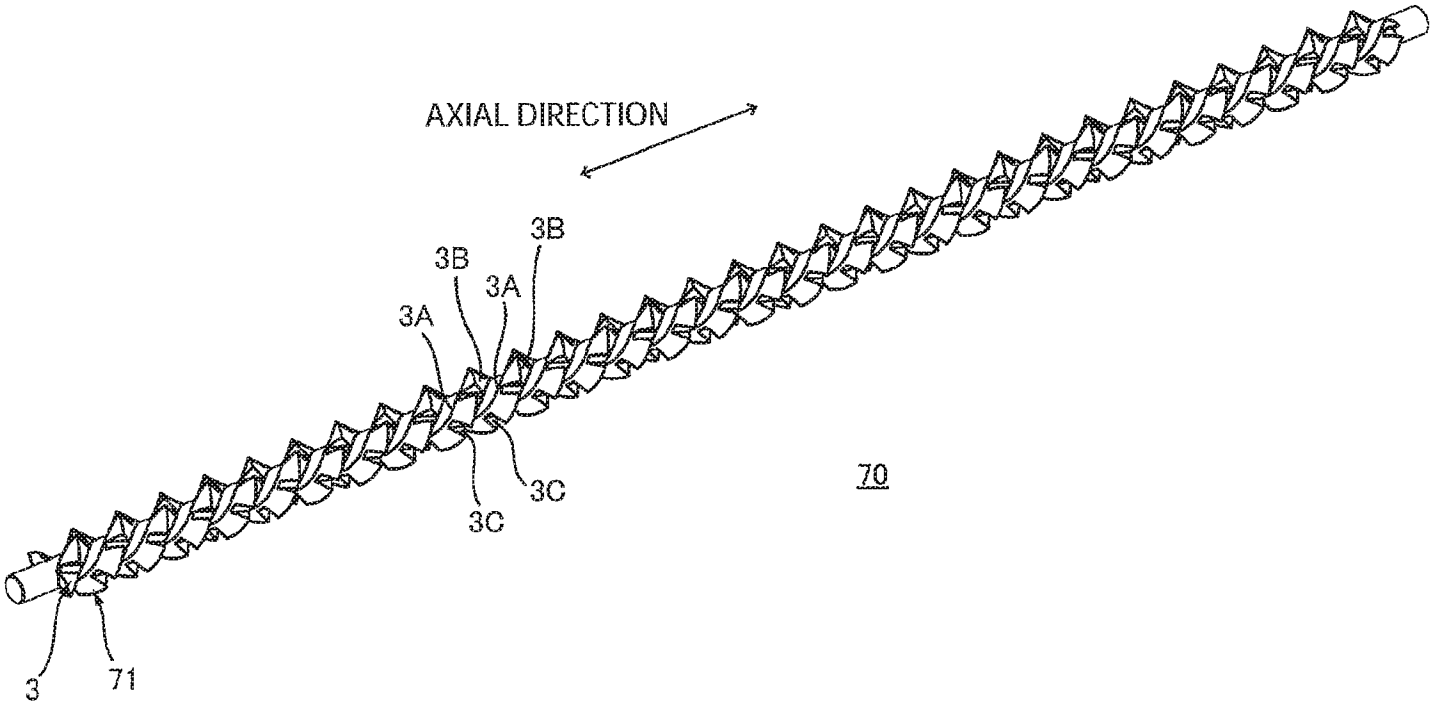
FIG. 12 is a perspective view of a cleaning roller according to a fourth embodiment.
Figure 13:
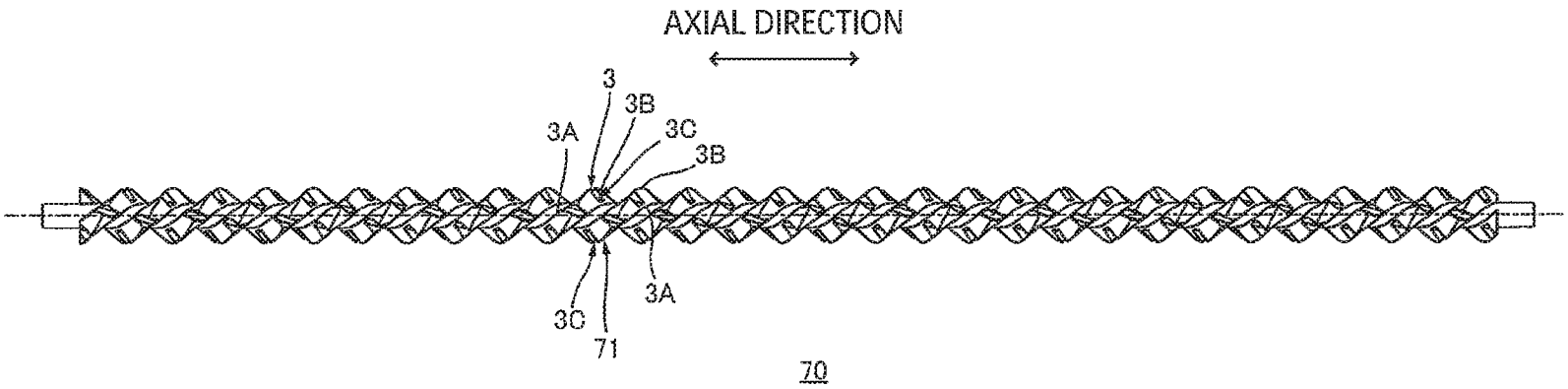
FIG. 13 is a side view of the cleaning roller illustrated in FIG. 12, illustrating the cleaning roller when viewed in a radial direction of a shaft of the cleaning roller.

As illustrated in FIG. 12, the cleaning roller 70 according to the fourth embodiment is provided with the elastic body 71 that configures a double helix together with the elastic body 3. Accordingly, the elastic body 3 and elastic body 71 can more reliably scrape foreign matter from the cleaning target.

(3) Variations of the Fourth Embodiment (3-1) First Variation

Figure 14A:
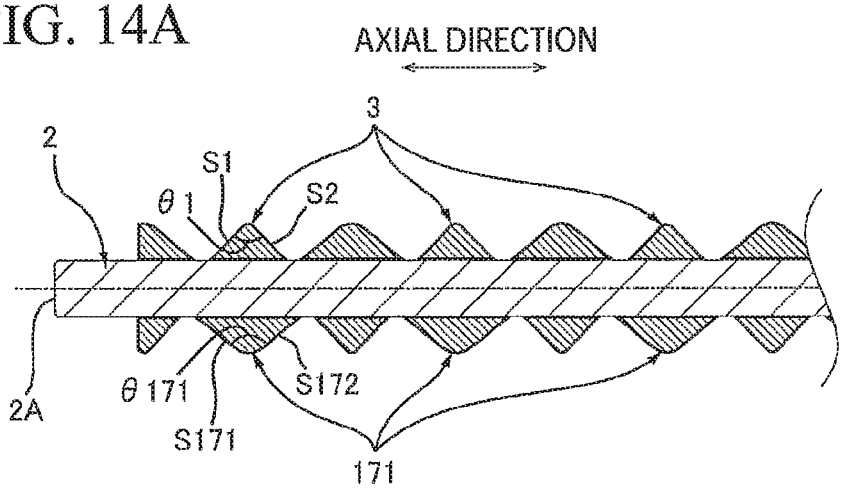
FIG. 14A is a cross-sectional view of an elastic body of a cleaning roller according to a first variation of the fourth embodiment, the cross-sectional view being taken along a plane containing a center axis of a shaft of the cleaning roller.

The width of the elastic body 71 in the fourth embodiment described above may differ from the width of the elastic body 3. More specifically, as illustrated in FIG. 14A, the cleaning roller according to the first variation of the fourth embodiment may be provided with an elastic body 171 instead of the elastic body 71. The width of the elastic body 171 according to the variation may be greater than the width of the elastic body 3. Specifically, the width of the base end portion 3A of the elastic body 171 according to the variation may be greater than the width of the base end portion 3A of the elastic body 3. Thus, A widthwise dimension of the base end portion 3A of the elastic body 171 in a widthwise direction (as an example of the claimed "second widthwise direction) orthogonal to the helical direction and to the radial direction of the shaft 2 is greater than the widthwise dimension of the base end portion 3A of the elastic body 3. The widthwise dimension of the base end portion 3A of the elastic body 171 is an example of the claimed "the widthwise dimension of the second base end portion".

In this variation, the angle θ171 formed by a first surface S171 and a second surface S172 of the elastic body 171 is different from the angle θ1 formed by the first surface S1 and second surface S2 of the elastic body 3, and specifically greater than the angle θ1. The first surface S171 is an example of the claimed "third surface" and also is an example of the claimed "outer surface". The second surface S172 is an example of the claimed "fourth surface" and also is an example of the claimed "outer surface". The angle θ1 is an example of the claimed "first angle". The angle θ171 is an example of the claimed "second angle".

(3-2) Second Variation

Figure 14B:
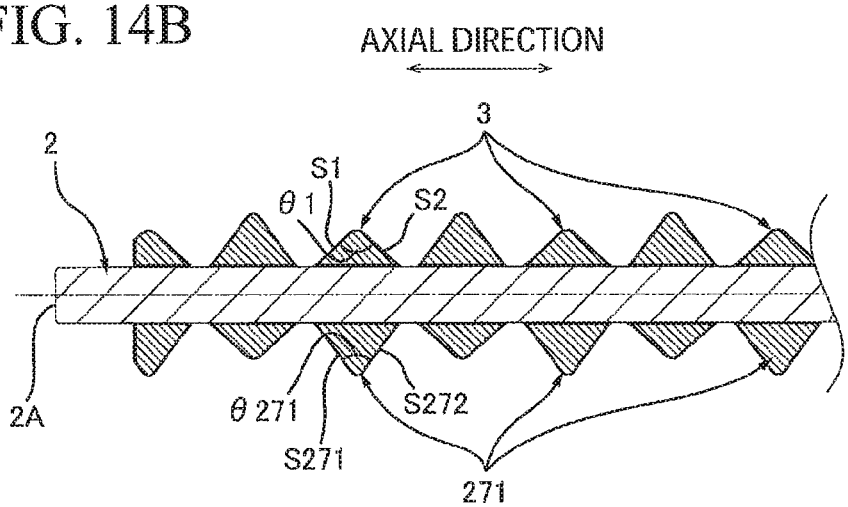
FIG. 14B is a cross-sectional view of an elastic body of a cleaning roller according to a second variation of the fourth embodiment, the cross-sectional view being taken along a plane containing a center axis of a shaft of the cleaning roller.

The height of the elastic body 71 in the fourth embodiment may differ from the height of the elastic body 3. More specifically, as illustrated in FIG. 14B, the cleaning roller according to the second variation of the fourth embodiment may be provided with an elastic body 271 instead of the elastic body 71. The height of the elastic body 271 may be greater than the height of the elastic body 3. In this case, the angle θ271 formed by a first surface S271 and a second surface S272 of the elastic body 271 is different from the angle θ1 formed by the first surface S1 and second surface S2 of the elastic body 3, and specifically smaller than the angle θ1. The first surface S271 is an example of the claimed "third surface" and also is an example of the claimed "outer surface". The second surface S272 is an example of the claimed "fourth surface" and also is an example of the claimed "outer surface". The angle θ271 is an example of the claimed "second angle".

(3-3) Third Variation

Figure 14C:
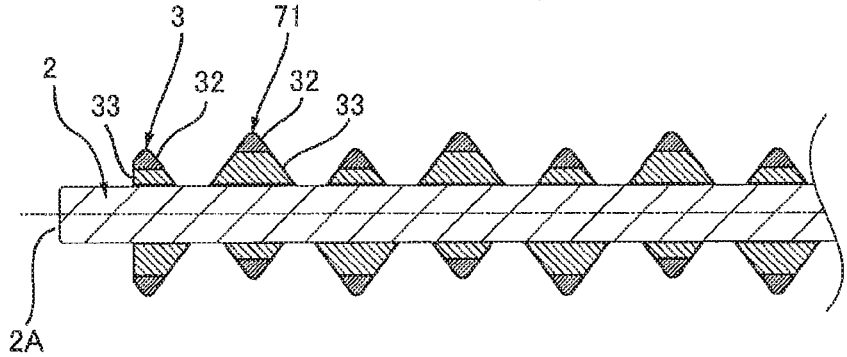
FIG. 14C is a cross-sectional view of an elastic body of a cleaning roller according to a third variation of the fourth embodiment, the cross-sectional view being taken along a plane containing a center axis of a shaft of the cleaning roller.

Further, as illustrated in FIG. 14C, each of the elastic body 3 and the elastic body 71 in the fourth embodiment described above may be provided with the first portion 32, and the second portion 33 formed of a different material from that of the first portion 32, as described in the third embodiment. In this case, the second portion 33 of the elastic body 71 may have a greater height than the second portion 33 of the elastic body 3, and the second portion 33 of the elastic body 71 may have a greater width than the second portion 33 of the elastic body 3. Note that the first portion 32 of the elastic body 3 and the first portion 32 of the elastic body 71 have the same shape.

(3-4) Fourth Variation

The recessed parts 3C formed in the elastic body 71 and the recessed parts 3C formed in the elastic body 3 in the fourth embodiment described above may be formed at different positions in the rotating direction of the cleaning roller 70.

In this case, the distal end portion 3B of the elastic body 71 overlaps the recessed parts 3C of the elastic body 3 in the rotating direction of the cleaning roller 70. In other words, the distal end portion 3B of the elastic body 71 overlaps the recessed parts 3C of the elastic body 3 as viewed in the axial direction. Also, the distal end portion 3B of the elastic body 3 overlaps the recessed parts 3C of the elastic body 71 in the rotating direction of the cleaning roller 70. In other words, the distal end portion 3B of the elastic body 3 overlaps the recessed parts 3C of the elastic body 71 as viewed in the axial direction. That is, the recessed parts 3C of the elastic body 3 and the recessed parts 3C of the elastic body 71 are displaced or offset from each other as viewed in the axial direction. The recessed parts 3C of the elastic body 3 is an example of the claimed "first discontinuous part". The recessed parts 3C of the elastic body 71 is an example of the claimed "second discontinuous part".

With this configuration, the distal end portion 3B of the elastic body 71 can scrape foreign matter that was not scraped off by the recessed parts 3C in the elastic body 3, while the distal end portion 3B of the elastic body 3 can scrape foreign matter that was not scraped off by the recessed parts 3C in the elastic body 71. Thus, this configuration can more reliably scrape off foreign matter deposited on the cleaning target.

(3-5) Fifth Variation

When the elastic body 3 in the fourth embodiment described above has recessed parts 3C, the recessed parts 3C may be omitted from the elastic body 71.

While the description has been made in detail with reference to specific embodiments and variations thereof, it would be apparent to those skilled in the art that various changes and modifications may be made thereto.

What is claimed is:

1. A cleaning roller comprising:

a shaft extending in an axial direction in which a center axis of the shaft extends, the shaft defining a radial direction and having a circumferential surface; and an elastic body helically wound about the shaft and defining a helical direction, the elastic body having a widthwise dimension in a widthwise direction orthogonal to the helical direction and to the radial direction, a pitch of the elastic body in a center portion of the elastic body in the axial direction being greater than that in an end portion of the elastic body in the axial direction, the elastic body having:

a base end portion extending in the helical direction, the base end portion being in contact with the circumferential surface and fixed thereto; and a distal end portion extending in the helical direction, the distal end portion being positioned farthest from the circumferential surface in the radial direction, the widthwise dimension being gradually reduced from the base end portion to the distal end portion in the radial direction.

2. The cleaning roller according to claim 1, wherein the elastic body has a contact surface, a first surface, and a second surface, wherein the contact surface is defined by the base end portion, the contact surface being in contact with the circumferential surface and fixed thereto, the contact surface having a first edge and a second edge in the widthwise direction, and wherein the first surface is positioned opposite to the second surface with respect to the distal end portion in the widthwise direction, the first surface connecting the first edge to the distal end portion, the second surface connecting the second edge to the distal end portion, the first surface and the second surface being connected to each other at the distal end portion.

3. The cleaning roller according to claim 1, wherein the elastic body includes a plurality of turn portions, and wherein, in cross-section taken along a plane containing the center axis, neighboring two of the plurality of turn portions being spaced away from each other in the axial direction.

4. The cleaning roller according to claim 1, wherein the elastic body has an outer surface connecting the base end portion to the distal end portion, the outer surface being curved to be recessed toward an inside of the elastic body.

5. The cleaning roller according to claim 1, wherein the elastic body comprises a first portion formed of a first material and a second portion formed of a second material different from the first material, the first portion including the distal end portion, the first material having a volumetric wear rate lower than that of the second material.

6. The cleaning roller according to claim 1, wherein the elastic body comprises a first portion formed of a first material and a second portion formed of a second material different from the first material, the first portion including the distal end portion, the second material having a restitution coefficient greater than that of the first material.

7. The cleaning roller according to claim 1, wherein the distal end portion is discontinuous in the helical direction.

8. The cleaning roller according to claim 1, wherein the elastic body comprises a first part constituting a portion of the elastic body in the helical direction and a second part constituting a portion of the elastic body in the helical direction, the second part having a shape different from that of the first part.

9. The cleaning roller according to claim 8, wherein the elastic body further comprises a third part constituting a portion of the elastic body in the helical direction, the third part having a shape the same as the second part, and wherein the second part and the third part is positioned on opposite sides of the first part in the axial direction.

10. The cleaning roller according to claim 1, further comprising a second elastic body helically disposed around the shaft to form a double helix together with the elastic body, the second elastic body defining a second helical direction and having:

a second base end portion extending in the second helical direction, the second base end portion being in contact with the circumferential surface and fixed thereto; and a second distal end portion extending in the second helical direction, the second distal end portion being positioned farthest from the circumferential surface in the radial direction.

11. The cleaning roller according to claim 10, wherein the second elastic body has a second contact surface, a third surface, and a fourth surface, wherein the second contact surface is defined by the second base end portion, the second contact surface being in contact with the circumferential surface and fixed thereto, the second contact surface having a first edge and a second edge in a second widthwise direction orthogonal to the second helical direction and to the radial direction, and wherein the third surface is positioned opposite to the fourth surface with respect to the second distal end portion in the second widthwise direction, the third surface connecting the first edge of the second contact surface to the second distal end portion, the fourth surface connecting the second edge of the second contact surface to the second distal end portion, the third surface and the fourth surface being connected to each other at the second distal end portion.

12. The cleaning roller according to claim 10, wherein a volumetric wear rate of the elastic body is different from that of the second elastic body.

13. The cleaning roller according to claim 10, wherein a restitution coefficient of the elastic body is different from that of the second elastic body.

14. The cleaning roller according to claim 10, wherein a height of the elastic body in the radial direction is different from that of the second elastic body.

15. The cleaning roller according to claim 10, wherein the second base end portion of the second elastic body has a widthwise dimension in a second widthwise direction orthogonal to the second helical direction and to the radial direction, the widthwise dimension of the second base end portion of the second elastic body being different from the widthwise dimension of the base end portion of the elastic body.

16. The cleaning roller according to claim 10, wherein the elastic body has a first discontinuous part so that the distal end portion is discontinuous in the helical direction, wherein the second elastic body has a second discontinuous part so that the second distal end portion is discontinuous in the second helical direction, and wherein the first discontinuous part and the second discontinuous part are displaced from each other when viewed in the axial direction.

17. A cleaning roller comprising:

a shaft extending in an axial direction in which a center axis of the shaft extends, the shaft defining a radial direction and having a circumferential surface; and an elastic body helically wound about the shaft and defining a helical direction, the elastic body having a widthwise dimension in a widthwise direction orthogonal to the helical direction and to the radial direction, the elastic body having a first part constituting, a portion of the elastic body in the helical direction and a second part constituting a portion of the elastic body in the helical direction, the second part having a shape different from that of the first part, the elastic body having:

a base end portion extending in the helical direction, the base end portion being in contact with the circumferential surface and fixed thereto; and a distal end portion extending in the helical direction, the distal end portion being positioned farthest from the circumferential surface in the radial direction, the widthwise dimension being gradually reduced from the base end portion to the distal end portion in the radial direction, wherein the widthwise dimension in the second part is greater than that in the first part.

18. A cleaning roller comprising:

a shaft extending in an axial direction in which a center axis of the shaft extends, the shaft defining a radial direction and having a circumferential surface; and an elastic body helically wound about the shaft and defining a helical direction, the elastic body having a widthwise dimension in a widthwise direction orthogonal to the helical direction and to the radial direction, the elastic body having a first part constituting a portion of the elastic body in the helical direction and a second part constituting a portion of the elastic body in the helical direction, the second part having a shape different from that of the first part, wherein the elastic body having a height dimension in the radial direction, and wherein the height dimension in the second part is greater than that in the first part, the elastic body having:

a base end portion extending in the helical direction, the base end portion being in contact with the circumferential surface and fixed thereto; and a distal end portion extending in the helical direction, the distal end portion being positioned farthest from the circumferential surface in the radial direction, the widthwise dimension being gradually reduced from the base end portion to the distal end portion in the radial direction.

19. A cleaning roller comprising:

a shaft extending in an axial direction in which a center axis of the shaft extends, the shaft defining a radial direction and having a circumferential surface; and an elastic body helically wound about the shaft and defining a helical direction, the elastic body having a widthwise dimension in a widthwise direction orthogonal to the helical direction and to the radial direction, the elastic body having:

a base end portion extending in the helical direction, the base end portion being in contact with the circumferential surface and fixed thereto; and a distal end portion extending in the helical direction, the distal end portion being positioned farthest from the circumferential surface in the radial direction, the widthwise dimension being gradually reduced from the base end portion to the distal end portion in the radial direction, a second elastic body helically disposed around the shaft to form a double helix together with the elastic body, the second elastic body defining a second helical direction, wherein the second elastic body has a second contact surface, a third surface, and a fourth surface, wherein a first angle formed by the first surface and the second surface is different from a second angle formed by the third surface and the fourth surface, the second elastic body having:

a second base end portion extending in the second helical direction, the second base end portion being in contact with the circumferential surface and fixed thereto; and a second distal end portion extending in the second helical direction, the second distal end portion being positioned farthest from the circumferential surface in the radial direction.

20. A cleaning roller produced by:

preparing a shaft having a circumferential surface;

preparing an elastic body extending in a prescribed direction, the elastic body having a width in a width direction orthogonal to the prescribed direction, the elastic body also having a height in a height direction orthogonal to the width direction and to the prescribed direction, the elastic body comprising:

a base end portion extending in the prescribed direction; and a distal end portion extending in the prescribed direction, the width being gradually reduced from the base end portion to the distal end portion in the height direction such that the elastic body has a triangular shape when viewed in the prescribed direction; and helically winding and fixing the elastic body on the circumferential surface of the shaft such that the base end portion is in contact with the circumferential surface and the distal end portion is positioned farthest from the circumferential surface in a radial direction of the shaft.

21. A cleaning roller produced by:

preparing a shaft comprising a circumferential surface;

preparing an elastic body extending in a prescribed direction, the elastic body having a width in a width direction orthogonal to the prescribed direction, the elastic body also having a height in a height direction orthogonal to the width direction and to the prescribed direction, the elastic body comprising:

a base end portion extending in the prescribed direction;

a distal end portion extending in the prescribed direction, the width being gradually reduced from the base end portion to the distal end portion in the height direction;

a first surface, a second surface and a third surface, each of which is positioned between the base end portion and the distal end portion, wherein the first surface and the second surface are positioned on opposite sides of the distal end portion in the width direction, the first surface being connected to one edge of the base end portion in the width direction, the first surface being separated from the distal end portion in the width direction and in the height direction, the second surface being connected both to the other edge of the base end portion in the width direction and to the distal end portion, the first surface sloping toward the second surface in the height direction from the base end portion toward the distal end portion, the second surface sloping toward the first surface in the height direction from the base end portion toward the distal end portion, and the third surface being positioned between the first surface and the distal end portion in both the width direction and the height direction, the third surface sloping toward the second surface in the height direction from the base end portion toward the distal end portion, wherein the second surface is longer than the first surface in the height direction, and wherein the third surface is shorter than the based end portion in the width direction; and helically winding and fixing the elastic body on the circumferential surface of the shaft such that the base end portion is in contact with the circumferential surface and the distal end portion is positioned farthest from the circumferential surface in a radial direction of the shaft.

* * * * *